United States Patent [19]

Fast

[11] Patent Number: 4,766,683

[45] Date of Patent: Aug. 30, 1988

[54] MAIL BAG TAG

[76] Inventor: Jacob Fast, 7561 NW. 9th St., Plantation, Fla. 33317

[21] Appl. No.: 5,898

[22] Filed: Jan. 21, 1987

Related U.S. Application Data

[63] Continuation-in-part of Ser. No. 841,302, Mar. 19, 1986, abandoned, which is a continuation-in-part of Ser. No. 777,337, Sep. 18, 1985, abandoned.

[51] Int. Cl.[4] ..... G09F 3/08

[52] U.S. Cl. ..... 40/665

[58] Field of Search ..... 40/2, 20 R, 21 R, 210

[56] References Cited

U.S. PATENT DOCUMENTS

| | | | |
|---|---|---|---|
| 1,517,456 | 12/1924 | Pulliam | 40/21 C |
| 1,540,455 | 6/1925 | Beck | 40/21 C |
| 2,721,408 | 10/1955 | Harris | 40/21 C |
| 3,706,147 | 12/1972 | Glaser | 40/2 R |
| 3,721,028 | 3/1973 | Lehner | 40/22 |
| 4,121,360 | 10/1978 | Vierbome | 40/586 |

FOREIGN PATENT DOCUMENTS

| | | |
|---|---|---|
| 420831 | 3/1967 | Switzerland . |
| 884536 | 12/1961 | United Kingdom . |

*Primary Examiner*—Gene Mancene
*Assistant Examiner*—Wenceslao J. Contreras
*Attorney, Agent, or Firm*—Holman & Stern

[57] ABSTRACT

A mailbag tag made of plastic sheet material is formed to fit on the encircling leather strap of a standard mailbag for providing a stable surface to support a routing bar code for scanning by a bar code reader. The tag has a flexible sidearm which is inserted through the strap hasp to form a hasp lock and the tag is designed to have sufficient strength enabling it to be used as a handle for carrying a filled mailbag.

10 Claims, 1 Drawing Sheet

MAIL BAG TAG

CROSS REFERENCE TO RELATED APPLICATION

This application is a continuation-in-part of application Ser. No. 841,302, filed Mar. 19, 1986 now abandoned which is itself a continuation in part of application Ser. No. 777,337 filed Sept. 18, 1985 now abandoned. The disclosures of both the parent and grandparent application are expressly incorporated herein by reference.

BACKGROUND

This invention relates to information tags intended specifically for use on standard Post Office mailbags, though not expressly limited to this single application.

As alluded to in the parent application, labeling problems arise in connection with filled mailbags insofar as routing directions at sorting offices and the like are commonly encoded by means of a bar code, to be scanned by a bar code reader, and difficulties are encountered in providing a suitable bar code carrier which can be readily secured to a mailbag, and which will have good resistance to detachment while providing an adequately stable flat surface for carrying a bar code so that the surface will not distort when scanned by a bar code reader.

It is important that a label tag be secured to a mailbag in a manner orienting the tag in a position to be easily scanned. Current practices employ a plastic holder attached with a plastic tie string which tends to move about, slide under the bag, turn upside down, fall between conveyor belts, and generally assume other positions which very often make the label unscannable by a bar code reader. Moreover, there is a temptation for workers to use the holder as a handle for lifting the bag, and frequently the strength of the holder is insufficient to endure the weight of a full bag so that the holder may tear off the bag.

SUMMARY OF INVENTION

It is an object of the invention to provide a novel and improved information tag particularly suitable for use on mailbags for the purposes indicated, and which overcomes, at least to a significant extent, the disadvantages associated with current mailbag labelling practices.

More particularly, it is an object of the invention to provide a form of mailbag tag which exhibits one or more of the following advantages compared with current mailbag labelling practices, notably: maintenance of a better position on a bag; improved readability; sufficient strength to enable the tag to be used as a handle; better cold and freeze resistance; resistance to being caught in conveyor belts, faster locking and incorporation in the tag structure of a self contained hasp lock; inventory savings by the elimination of the plastic attachment loop.

In fulfillment of the above and other objects, the invention provides a mailbag tag in the form of a generally rectangular card of plastic sheet material, preferably about 7 inches by 3 inches in overall area and having a thickness of about 0.0325±0.0015 inch. At one end, the card is provided with a pair of spaced elongate slots whereby the tag may be threaded onto a standard leather mailbag strap provided with an eye-type hasp and a hasp aperture, the card further including a flexible side arm adjacent to the slots which, with the tag suitable positioned on the strap adjacent to hasp, with the strap encircled around the bag to close same, and with the hasp aperture fitted over the hasp, can be inserted through the hasp to provide a hasp lock. The side arm can, for example, be defined by a cutout in the card extending from one longitudinal edge of the card.

A tag in accordance with the invention is designed, inter alia, to attach to the strap in a manner providing stability for reading of a bar code by a bar code, reader, and to have sufficient strength enabling it to be used as a bag handle.

Additional features and advantages of the invention will become apparent from the following description and claims read in conjunction with the attached drawings.

DESCRIPTION OF PREFERRED EMBODIMENT

Figure 1:
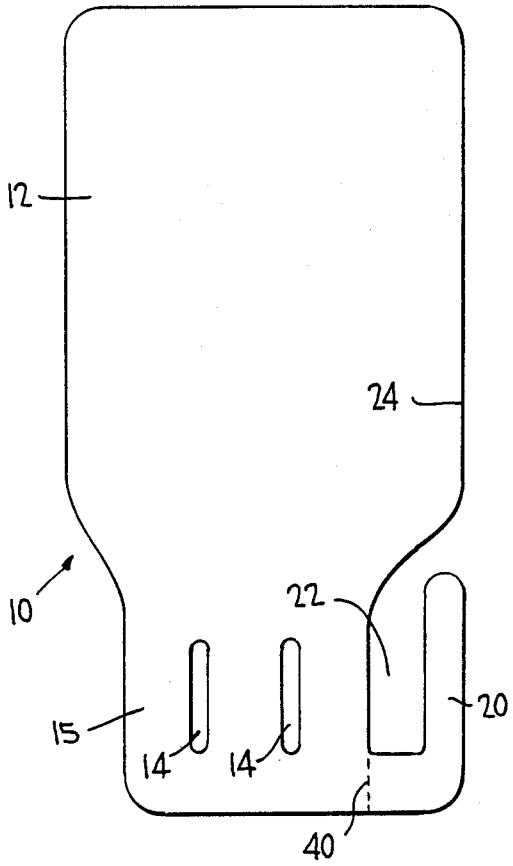
FIG. 1 is a plan view of a mailbag tag in accordance with the invention.

A mailbag tag 10 in accordance with the invention is die cut or the like from plastic sheet, preferably having a thickness of about 0.0325 inches. The tag has a generally rectangular body portion 12 and a reduced width neck portion 15. The overall dimensions of the tag preferably are about 7"×3".

Neck portion 15 of the tag is formed with a pair of adjacent elongate slots 14 about 1" long and ⅛" wide for threading the tag onto the leather strap 16 of a standard Post Office mailbag 18. Adjacent the neck portion, tag 10 is formed with a flexible sidearm 20 parallel to slots 14, the sidearm being defined by a cutout 22 extending from longitudinal edge 24 of the tag. The sidearm is about 1½ inch long and about ¼ inch wide.

Mailbag strap 16 is located adjacent the eyeleted rim 28 of the bag and is provided with an eye-type hasp 26 toward one end, which also attaches the strap to the bag. Adjacent its other end, the strap is provided with a buckle 30 and an elongate aperture 32 adapted to fit over the hasp.

Figure 2:
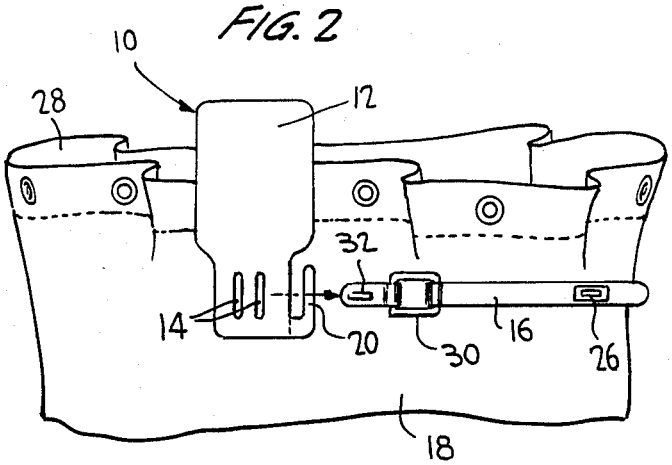
FIGS. 2 and 3 are elevational views of the top portion of a mailbag showing sequential steps in securement of the tag to the bag.
Figure 3:
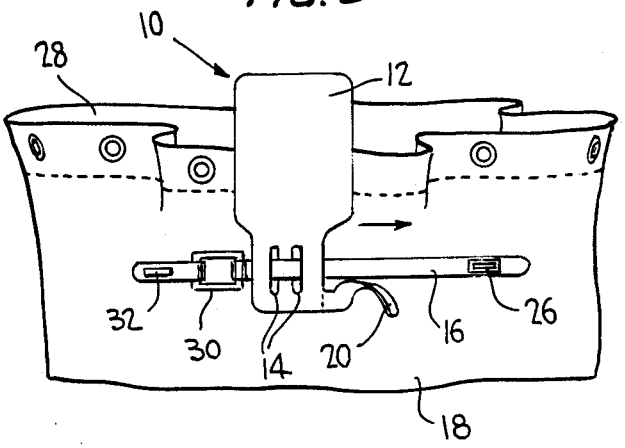
Figure 4:
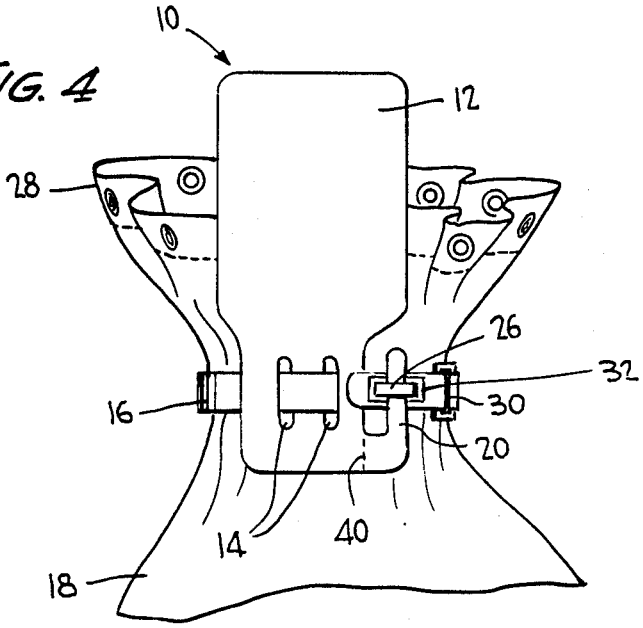
FIG. 4 is a view similar to FIGS. 2 and 3, somewhat enlarged, and showing the tag fully attached to the bag.

To attach tag 10 to the mailbag, the buckle end of the strap 16 is passed downwardly through one of the slots 14 then upwardly through the adjacent slot 14 so as to thread the tag onto the strap. Preferably, this operation is carried out with the body portion 12 of the tag facing toward the rim of the bag and with sidearm 20 facing the hasp 26 as shown in FIGS. 2 and 3. The tag may then be moved along the strap until sidearm 20 is adjacent to the hasp.

When the bag is to be closed, the buckle end of the strap is drawn around the back of the bag, so that the strap gathers and encircles the bag, and aperture 32 is fitted over the hasp 26. To lock the bag, sidearm 20 of the tag can then be twisted upwardly (as illustrated in FIG. 3) and in inserted through the hasp above the belt portion containing aperture 32 (see FIG. 5). The bag is then securely closed and locked. The tag may have a crease 40 to facilitate upward bending of the sidearm.

When attached as described above, the tag provides a flat and stable surface for scanning a routing bar code used on the tag. Also, the tag is of sufficient strength to allow the body portion to be used as a handle for carrying a mailbag.

While only a preferred embodiment of the invention has been described herein in detail, the invention is not limited thereby and modifications can be made within the scope of the attached claims.

What is claimed is:

1. An information tag suitable for mounting on a mailbag strap, the tag comprising a card of plastic sheet material having a body portion and an adjacent attachment portion at one end of the body portion, a pair of substantially parallel elongate slots in the attachment portion for threading the tag on the strap, and the tag further including a flexible sidearm at the side of the attachment portion with a free end for insertion of the side arm through a hasp on the strap to provide a hasp lock, the side arm being substantially adjacent and parallel to said slots.

2. The information tag as defined in claim 1 wherein the sidearm is defined by a cutout extending from a side edge of the tag.

3. The information tag as defined in claim 2 wherein the sidearm is connected to the attachment portion by a transverse neck which includes a crease to facilitate bending of the sidearm upwardly with respect to a plane containing the body portion.

4. The information tag as defined in claim 2 wherein the attachment portion has a narrower width than the body portion.

5. The information tag as defined in claim 1 wherein the plastic sheet has a thickness of $0.0325 \pm 0.0015$ inch and is of sufficient strength for supporting the weight of a full mailbag when attached as aforesaid.

6. The invention of claim 5 wherein the tag is of substantially rectangular shape measuring about $7'' \times 3''$.

7. A combination comprising a mailbag having an encircling strap for closing the bag, the strap having an eye-type hasp and an aperture engaging over the hasp, an information tag of plastic sheet material on the strap, the tag comprising a body portion for routing information and an attachment portion having a pair of substantially parallel elongate slots through which the strap is threaded, and a flexible sidearm adjacent the attachment portion, the sidearm being inserted through the hasp over a section of the strap containing said aperture to provide a hasp lock.

8. The combination as defined in claim 7 wherein the sidearm is connected to the attachment portion by a transverse neck which includes a crease to facilitate bending of the sidearm upwardly with respect to a plane containing the body portion.

9. The combination as defined in claim 7 wherein the body portion of the tag extends towards a rim section of the mailbag.

10. The combination as defined in claim 7 wherein the plastic sheet has a thickness of $0.0325 \pm 0.0015$ inch and is sufficient strength for supporting the weight of the mailbag.

* * * * *